United States Patent [19]

Rembold et al.

[11] Patent Number: 4,536,767

[45] Date of Patent: Aug. 20, 1985

[54] MICROWAVE DIRECTIONAL ANTENNA EMPLOYING SURFACE WAVE MODE

[75] Inventors: Bernhard Rembold, Neu-Ulm; Klaus Solbach, Ulm, both of Fed. Rep. of Germany

[73] Assignee: Licentia Patent-Verwaltungs-GmbH, Fed. Rep. of Germany

[21] Appl. No.: 476,354

[22] Filed: Mar. 17, 1983

[30] Foreign Application Priority Data

Mar. 25, 1982 [DE] Fed. Rep. of Germany ..... 3210895
Aug. 5, 1982 [DE] Fed. Rep. of Germany ..... 3217437

[51] Int. Cl.[3] ..... H01Q 13/28
[52] U.S. Cl. ..... 343/785; 343/753
[58] Field of Search ..... 343/753, 781 P, 785, 343/767, 769

[56] References Cited

U.S. PATENT DOCUMENTS

| | | | |
|---|---|---|---|
| 2,624,003 | 12/1952 | Iams | 343/785 |
| 2,663,797 | 12/1953 | Kock | 343/785 |
| 2,921,309 | 1/1960 | Elliott | 343/781 P |
| 2,993,205 | 7/1961 | Cooper | 343/785 |
| 3,434,146 | 3/1969 | Petrich | 343/753 |
| 3,577,147 | 5/1971 | Hannan | 343/785 |

*Primary Examiner*—Eli Lieberman
*Attorney, Agent, or Firm*—McGlew and Tuttle

[57] ABSTRACT

A microwave directional antenna, particularly for the millimeter-wave range, comprises a dielectric line with line discontinuities, affixed to a metallic ground plane. The dielectric line is a radial waveguide extending about a center where the feed is provided. A mode launcher is located at this center. In a preferred embodiment, the boundary of the dielectric line circumscribes a circle; the line discontinuities are preferably embodied as metallic strips arranged on the dielectric guide on circles about the center.

9 Claims, 10 Drawing Figures

MICROWAVE DIRECTIONAL ANTENNA EMPLOYING SURFACE WAVE MODE

FIELD AND BACKGROUND OF THE INVENTION

This invention relates in general to microwave directional antennas and in particular to a new and useful microwave directional antenna particularly for the millimeter-wave range.

In the design of directional antennas strongly focusing in two planes, three antenna systems are usually employed in the microwave and millimeter-wave ranges: (1) Horn radiators, (2) Antenna arrays, (3) reflector antennas.

Horn radiators are used in practice only for antennas having a directive gain less than 25 db, since at higher gains a too long horn radiator and thus an unhandy antenna structure would be obtained. Antenna arrays, such as waveguide slot antennas, save much space (they are planar), however, their design and manufacture are expensive. Antenna arrays in the form of etched half-wave resonators in microstrip technique are also very flat, their gains are not too high, however, because of the inevitable losses. Reflector antennas, such as parabolic mirror antennas, are simple to construct and transmit a very broad band, only they are not flat enough for many applications.

SUMMARY OF THE INVENTION

The present invention is directed to an antenna which is simple in construction and has a flat shape similar to that of waveguide slot antenna arrays or planar etched antennas, for example.

In accordance with the invention a microwave directional antenna is provided particularly the millimeter-wave range which comprises a dielectric line on a metallic ground plane with a plurality of line discontinuities and having dielectric lines of radial forms starting from a center at which the line of feed of the dielectric is provided, and including a mode changer for transforming waves of the feed line to the dielectric line at the center, and wherein the line discontunities are arranged on circles about the center at distributed locations.

A further object of the invention is to provide a microwave directional antenna which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which preferred embodiments of the invention are illustrated.

DESCRIPTION OF THE PREFERRED EMBODIMENTS

Figure 1:
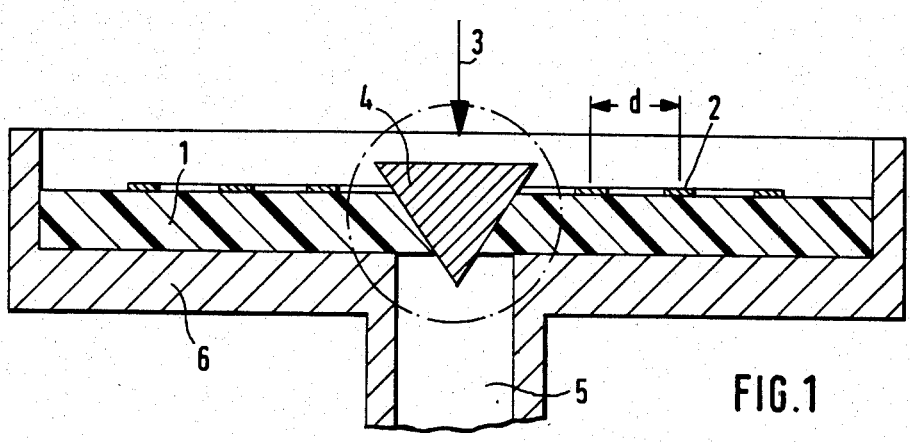
FIG. 1 is a sectional view of a microwave directional antenna constructed in accordance with the invention.

Referring to the drawings in particular the invention embodied therein in FIG. 1 comprises a microwave directional antenna particularly for the millimeter-wave range which comprises a dielectric line 1 on a flat surface of metallic ground plane 6 and including a plurality of line discontinuities 2. Plane 6 is flat and circular and has an outer axially external wall which surrounds the line 1 and has a greater axial width than line 1. The dielectric line 1 comprises a line of radial forms starting from a center 3 at which the line of feed of the dielectric is provided through a circular hollow waveguide 5. The construction includes a transition for transforming waves of the feed line 5 to the dielectric line at the center designated 4. The line discontinuities are arranged on circles about the center at distributed or spaced locations.

Figure 2:
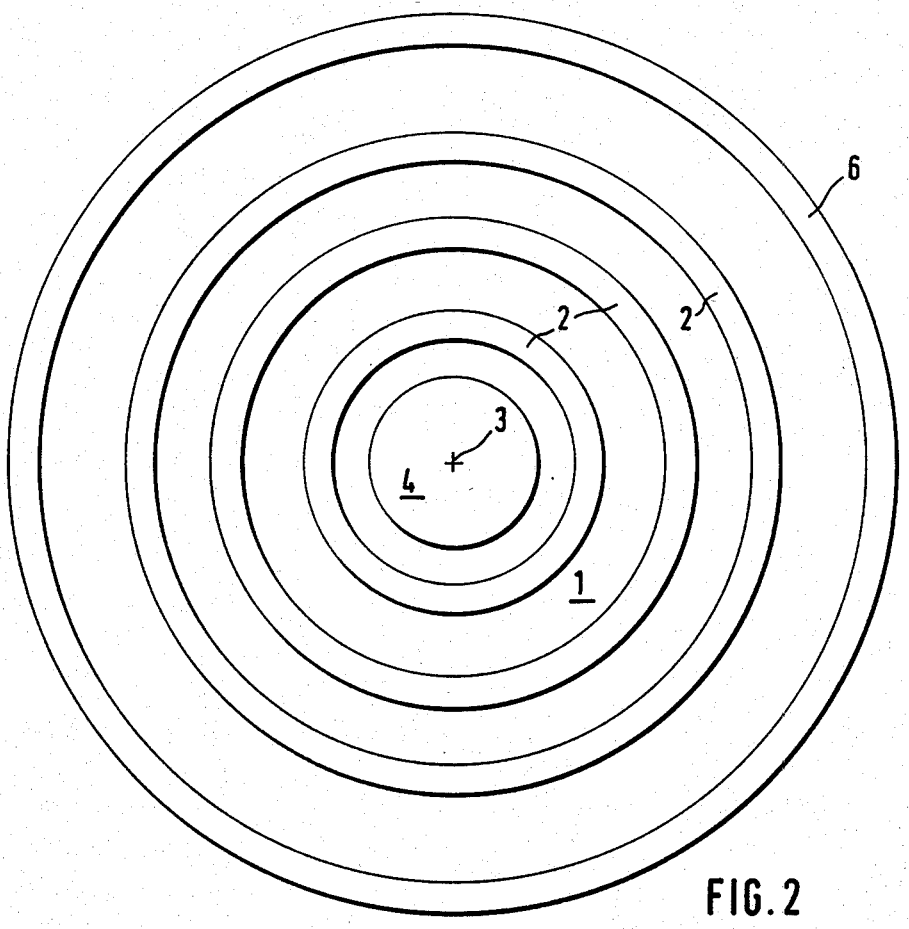
FIG. 2 is a plan view of the antenna shown in FIG. 1.
Figure 3:
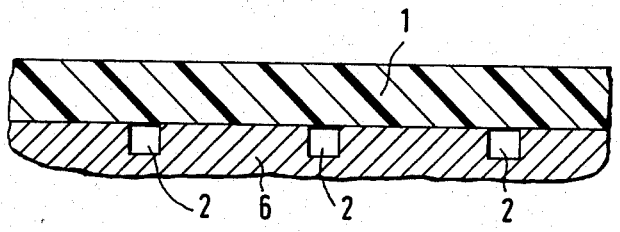
FIG. 3 is a partial sectional view of another embodiment of the invention in which the conducting ground plane includes grooves.
Figure 4:
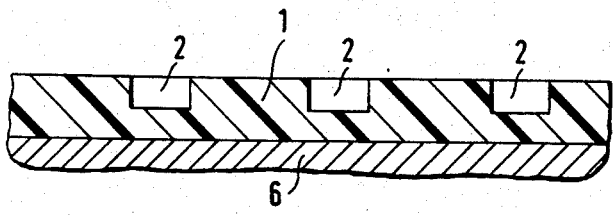
FIG. 4 is a view similar to FIG. 3 with another embodiment of the invention using stepped thickness.
Figure 10:
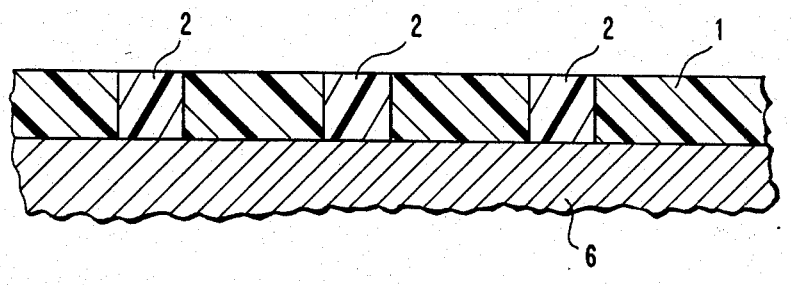
FIG. 10 is a view similar to FIG. 4 but showing variations in dielectric constant rather than variations or steps in thickness.

FIG. 1 shows one embodiment of the invention, namely an antenna which comprises a flat circular dielectric disk 1 in contact with an electrically conducting ground plane 6. This combination can be effective as a radial dielectric image line. That is, by means of a conical transition 4, waves can be excited on dielectric disk 1, propagating from center 3 outwardly. Analogously to waves guided on straight cylindrical dielectric image lines (as known from IRE Trans. MTT, vol. MTT-5, No. 1, 1957, pages 31 to 35), the waves guided by the radial dielectric image line can be caused to radiate at wave traps or chokes (line discontinuities or obstacles). In accordance with the invention, the line discontinuities 2 are disposed on circles about the center 3 of the antenna. Such discontinuities may be embodied, for example, by metallic strips applied to the dielectric, see IEEE Trans. MTT, vol MTT-26, Oct. 1978, pp 764 to 773. In the embodiment of FIGS. 1 and 2, the metallic strips 2 are arranged concentrically about center 3. Other line discontinuities known in the art may also be provided, for example grooves in the ground plane (Fig.3), or stepped thicknesses, FIG. 4, or variations in dielectric constants of the dielectric, (FIG. 10). In this connection see Proceedings 1977 IEEE MTT-5 Int. Microwave Symposium Digest pp 538 to 541, or IEEE Trans. MTT, vol. MTT-29, No. 1, 1981, pp 10 to 16.

The inventive directional antenna is fed at center 3, perpendicularly from above or below, through a hollow waveguide or a straight dielectric line. In the advantageous embodiment of FIGS. 1 and 2, the feeder line is a circular hollow waveguide 5 extending from below through ground plane 6.

Figure 5:
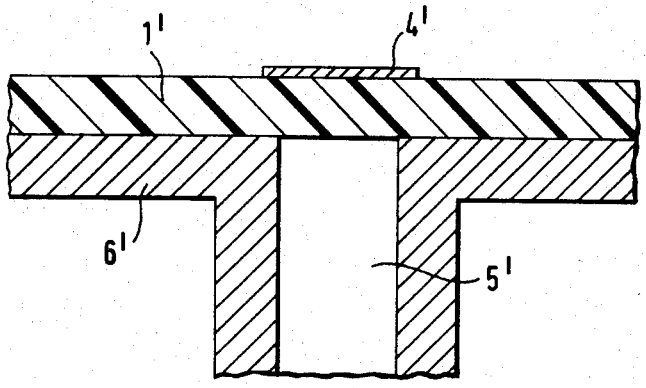
FIG. 5 is a view similar to FIG. 1 of another embodiment of the invention.
Figure 6:
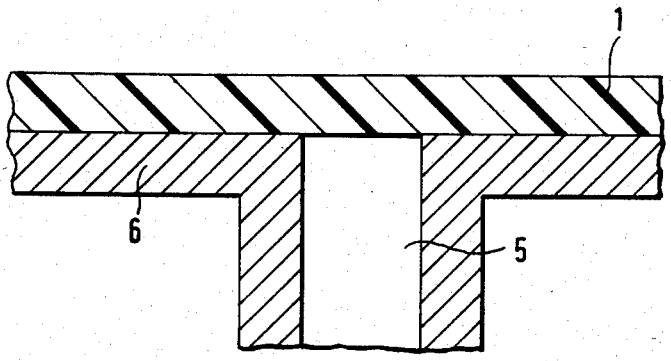
FIG. 6 is a view similar to FIG. 1 of still another embodiment of the invention.

The waves transmitted through a feeder line are to be transformed into waves propagating along the radial dielectric image line. For this purpose, various transitions or launchers may be employed. FIG. 1 shows an arrangement corresponding to a horn radiator transition used in straight dielectric guides, see IRE Trans. MTT, vol. MTT-3, 1955, No. 12, pp 35 to 39. Another form of a transition is shown in FIG. 5. In this embodiment the wave guided by waveguide 5 is deflected to dielectric disk or guide 1' at a flat metallic disk 4' placed on the dielectric. Accordding to FIG. 6, the transition is embodied simply by the aperture of feeder waveguide 5, which is provided in conducting ground plane 6, and by overlaying dielectric guide 1'. In IEEE Trans. MTT, vol. MTT-29, No. 1, 1981, pp 10 to 16, where an analogously designed transition in straight dielectric image lines is discussed, it is shown that a part of the wave issuing from the hollow waveguide aperture is radiated directly, while the remaining part of the wave is deflected to the dielectric image line 1.

The cross sections of the feeder lines and of the transition may be circularly or elliptic, or of any angular (or mixed) shape.

The radiation characteristic of the inventive antenna is determined by the distribution of the outgoing waves excited by transition 4 over the circumference thereof, and by the spacing d of the line discontinuities 2.

The field distribution over the circumference of mode changer 4 again results from the field distribution of the feed wave in circular waveguide 5.

For example, a perpendicular main direction of radiation of the antenna may be obtained by providing a spacing d of line discontinuities 2 in the wavelength on radial guide 1, and by using the $TE_{11}$-mode of circular waveguide 5 for exciting the antenna.

Figure 7:
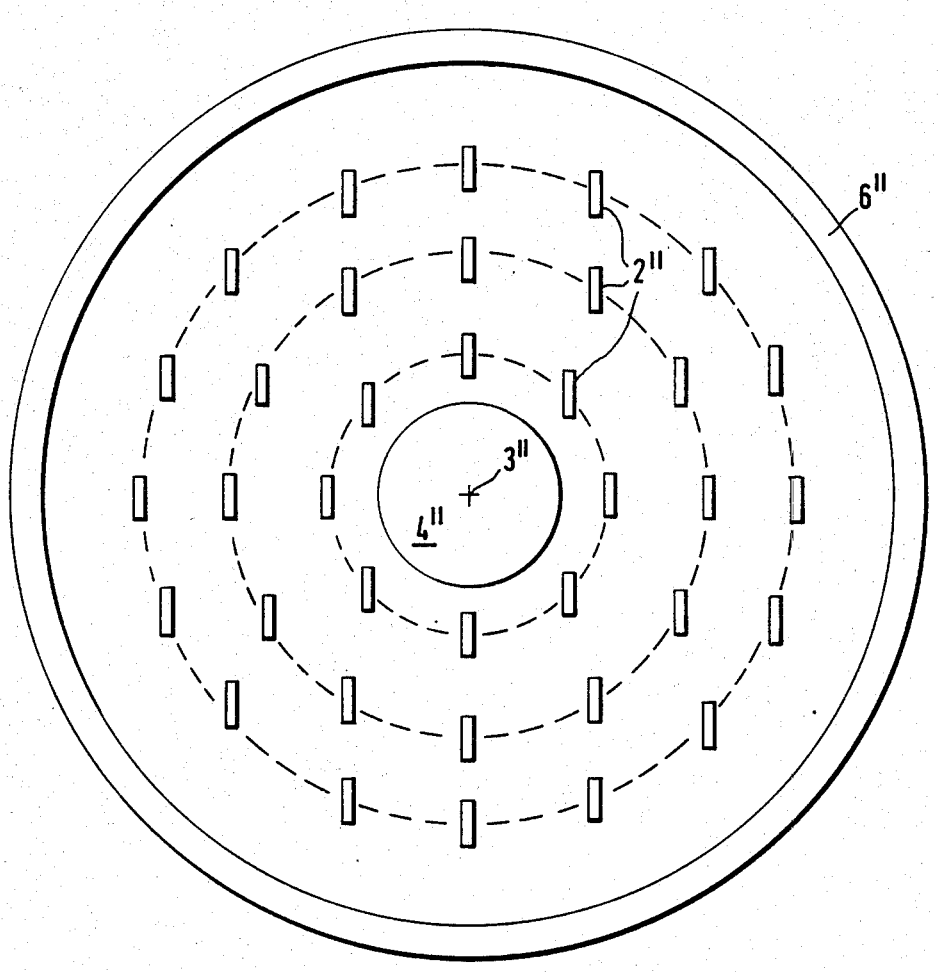
FIG. 7 is a view similar to FIG. 2 of another embodiment of the invention.
Figure 8:
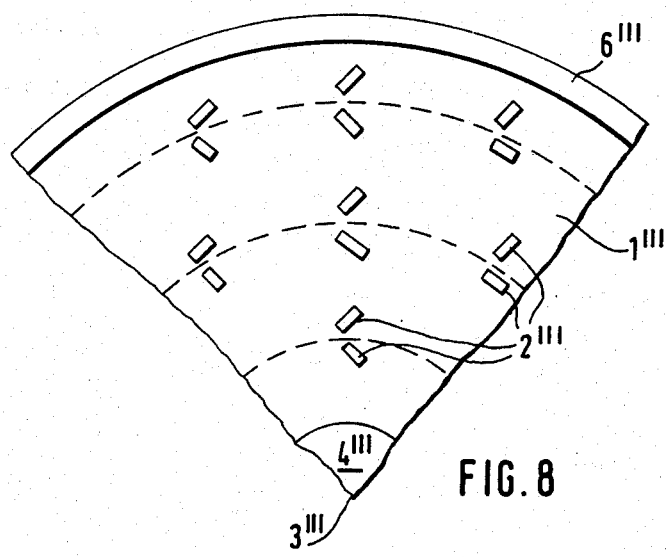
FIG. 8 is a partial top plan view similar to FIG. 7 of another embodiment of the invention.
Figure 9:
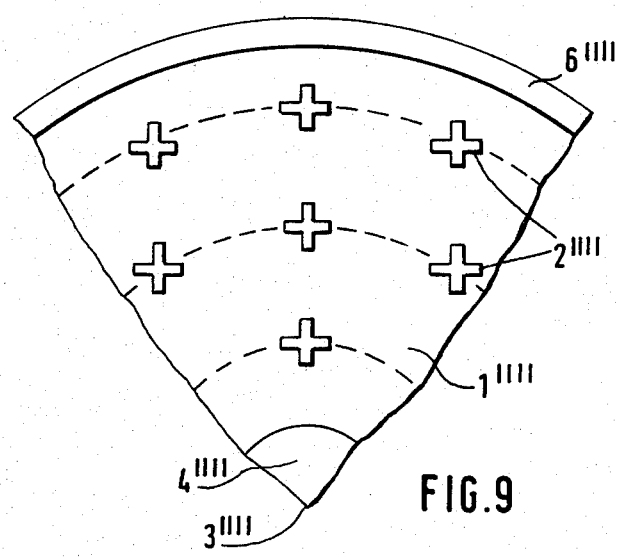
FIG. 9 is a view similar to FIG. 8 still another embodiment of the invention.

The direction of polarization of the wave radiated by the antenna is determined by the arrangement of line discontinuities 2''. FIGS. 7 and 8 show particularly advantageous embodiments in this ragard (FIG. 8 in sectors). According to FIG. 7, line discontinuities are designed as short conductor strips located on circles about center 3'' of the antenna. The axes of the conductor strips extend all in the same direction, so that a linear antenna polarization is obtained. Discontinuities 2''' with axes alternately in different directions (FIG. 8) or in the shape of crosses 2'''' (FIG. 9), for example, may also be provided, to obtain a circular or elliptic polarization of the antenna.

While specific embodiments of the invention have been shown and described in detail to illustrate the application of the principles of the invention, it will be understood that the invention may be embodied otherwise without departing from such principles.

What is claimed is:

1. A microwave directional antenna, comprising:

a flat circular metallic ground plate (6) having a flat surface with a central circular opening therein, said ground plate having a circular outer wall extending axially outwardly from said flat surface, a flat circular disc (1) of dielectric material lying over and in contact with said flat surface of said ground plate, said disc covering said central opening and having an outer flat surface facing away from said flat surface of said ground plate, said disc covering said opening and extending to said wall of said ground plate;

a hollow circular waveguide (5) made of metal and connected to said ground plate, said hollow waveguide having a central passage communicating with said opening of said ground plate for supplying microwave radiation to said disc;

a metal transition member (4) connected to said disc at a center of said disc and overlying said opening of said ground plate for changing a mode of propagation of microwave radiation from said waveguide to said disc; and a plurality of line discontinuities (2) at least at said outer flat surface of said disc, said discontinuities lying in a plurality of concentric radially spaced rings in said outer flat surface of said disc, said rings being radially spaced by an equal selected spacing (d) to effect a radiation characteristic for microwave radiation propagating radially through said disc whereby microwave radiation propagating radially through said disc is deflected to radiate axially from said disc upon approaching said discontinuities.

2. An antenna according to claim 1, wherein said axially extending wall of said ground plate has an axial length greater than an axial width of said disc, said metal transition member (4) being conical in radial cross-section with a flat outer surface extending axially beyond said outer surface of said disc and a pointed inner end extending centrally into said hollow waveguide, each of said discontinuities comprising a metal ring lying on said outer surface of said disc and over one of said rings.

3. An antenna according to claim 1, wherein said metal transition member (4) comprises a flat circular metal layer on said outer surface of said disc covering said opening of said ground plate surface.

4. An antenna according to claim 3, wherein said discontinuities (2) comprises a plurality of discrete metal layers circumferentially distributed in each of said rings and lying on said outer surface of said disc.

5. An antenna according to claim 4, wherein each of said discrete metal layers is rectangular and elongated in the same parallel direction.

6. An antenna according to claim 4, wherein said discrete metal layers are each rectangular and elongated, said discrete metal layers divided into one group all being elongated in one parallel direction and a second group all being elongated in a perpendicular parallel direction, one metal layer from each group lying adjacent each other in pairs around said rings.

7. An antenna according to claim 4, wherein each of said discrete metal layers is cross-shaped and extends in the same parallel direction as each other one of said discrete metal layers.

8. An antenna according to claim 1, wherein each of said discontinuities comprises an annular groove in said outer surface of said disc lying on one of said rings.

9. An antenna according to claim 2, wherein each of said discontinuities comprises said disc made of material having a different dielectric constant at each of said rings, than the material of a remainder of said disc.

* * * * *